United States Patent [19]

Lin

[11] Patent Number: 4,847,993

[45] Date of Patent: Jul. 18, 1989

[54] COST-SAVING PROCESS FOR MAKING PLUG BLADES DIRECTLY FROM A LINEAR STRIP

[76] Inventor: Mei-Mei Lin, 30.21 P.O. Box 1016., Taipei, Taiwan

[21] Appl. No.: 246,751

[22] Filed: Sep. 20, 1988

[51] Int. Cl.[4] ..... H01R 43/00

[52] U.S. Cl. ..... 29/874; 29/884; 72/404

[58] Field of Search ..... 29/874, 882, 884, 885; 72/379, 404 X

[56] References Cited

U.S. PATENT DOCUMENTS

| | | | |
|---|---|---|---|
| 2,116,269 | 5/1938 | Kobzy | 29/874 |
| 2,231,347 | 2/1941 | Reutter | 29/882 |
| 2,799,237 | 7/1957 | Martines | 29/874 |
| 3,149,898 | 9/1964 | Klumpp, Jr. | 29/874 X |
| 3,377,700 | 4/1968 | Cooley | 29/882 |
| 4,543,811 | 10/1985 | Aoyama | 72/404 X |
| 4,605,279 | 8/1986 | Mixon, Jr. | 72/404 X |

*Primary Examiner*—Timothy V. Eley
*Assistant Examiner*—Frances Chin

[57] ABSTRACT

A process for making blades of an electric plug directly from a linear strip includes: forming a longitudinal metallic strip from a rod coil; punching the strip to form plural blade members; directly flattening and thinning a rear root portion of each blade for crimping an electric wire so that a longitudinal strip can be conveniently formed into a plurality of plug blades without wasting much scraps cut from the metallic strip.

4 Claims, 3 Drawing Sheets

COST-SAVING PROCESS FOR MAKING PLUG BLADES DIRECTLY FROM A LINEAR STRIP

BACKGROUND OF THE INVENTION:

A conventional method for making blades of a plug is shown in FIG. 15 in which a copper sheet M is punched to form a plurality of blades B juxtaposionally secured on the base sheet, which however may have the following drawbacks:

1. The scraps S as remained on the metal sheet S may waste the raw material of brass about 35–45%.

2. The rear portion B1 of each blade B should be further milled for reducing its thickness available for crimping a wire lead to a power source.

3. If the rear portion B1 of the blade B is not milled to be thinner, a complex welding or soldering process should be further provided for connecting an electric wire.

4. The production cost, such as labor cost, mold making and repair fees or wasting material of scraps, will be increased. Furthermore, the control of product dimensions and the surface finishing of the product is very difficult.

The present inventor has found such drawbacks of a conventional process for making plug blades and invented the present process for making blades with cost-saving methods, but wih good quality.

SUMMARY OF THE INVENTION:

The object of the present invention is to provide a process for making blades of an electric plug including: forming a longitudinal metallic strip; punching the strip to form perforations, tapered portions and neck portion for respective units of plug blades; and flattening of a rear root portion of each blade directly by ramming, flattening and bending of punching operations adapted for crimping a wire lead of a power source, so that the linear longitudinal metallic strip can be conveniently converted into a plurality of plug blades, with minimum wasting of metallic scrap.

DETAILED DESCRIPTION

Figure 1:
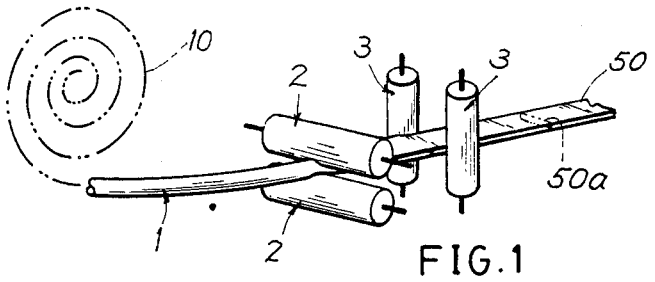
FIG. 1 shows a first step for making a longitudinal strip of the present invention.
Figure 2:
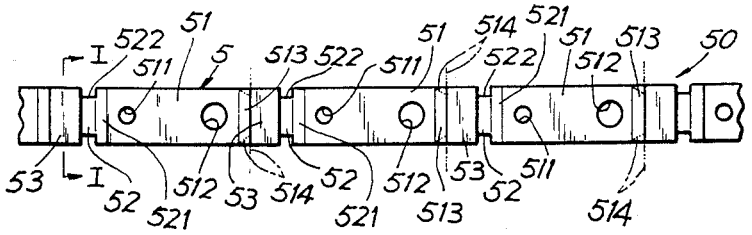
FIG. 2 is a top-view illustration showing the punched strip of the present invention.
Figure 3:
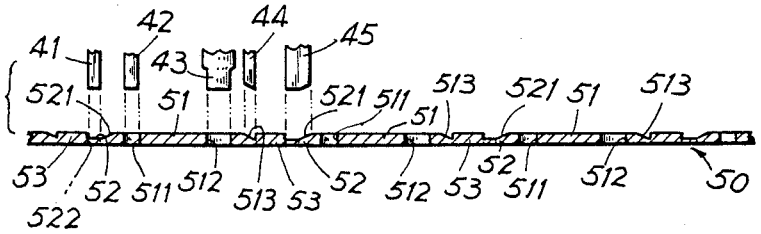
FIG. 3 is a side-sectional drawing showing the punched strip with several punches of the present invention.
Figure 4:
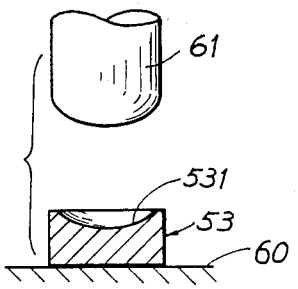
FIG. 4 is an illustration showing a first ramming of the rear blade portion of the present invention, as viewed from I–I direction of FIG. 2.
Figure 5:
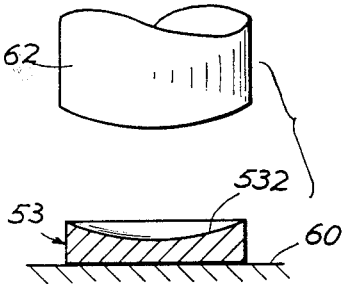
FIG. 5 shows a second ramming of the rear blade portion of the present invention.
Figure 6:
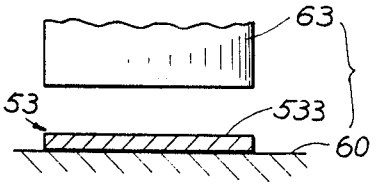
FIG. 6 shows a flattening of the rear blade portion of the present invention.
Figure 7:
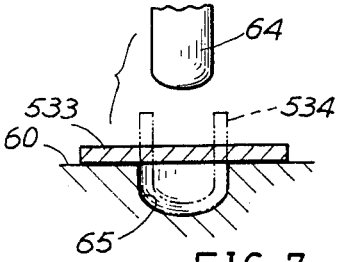
FIG. 7 shows a bending of the rear blade portion of the present invention.

As shown in FIGS. 1–8, the present invention comprises: forming a longitudinal metallic strip 50 as shown in FIG. 1; punching the strip 50 as shown in FIGS. 2 and 3; and a flattening of a rear root portion 53 of each plug blade 5 as shown in FIGS. 4–7.

As shown in FIG. 1, a coil of metallic rod 1 having electrical conductivity such as copper or brass is first milled by at least a pair of horizontal rolls 2 and then milled by at least a pair of vertical rolls 3 for making a longitudinal metallic strip 50 having a cross section of a general rectangular shape 50*a*.

As shown in FIGS. 2 and 3, the longitudinal strip 50 is formed with a plurality of plug blades 5 each blade 5 having a front blade portion 51, a rear root portion 53 pertaining to a rear portion of the front portion 51 by a neck portion 52. The neck portion 52 is formed by a pair of cutting punches 41, punching off two side portions 521 of the neck portion. Two perforating punches 42, 43 are used to form an inner hole 511 and an outer hole 512. Two tapering punches 44, 45 are respectively provided to press a front rim 513 of the front portion 51 to be tapered frontwardly and to press a neck portion 52 to be tapered rearwardly. All the punching operations as shown in FIGS. 2, 3 are similar to those steps required by a conventional method for making plug blades. The dotted line 514 as shown in FIG. 2 defines a cutting line for breaking down each blade in a production line.

Figure 8:
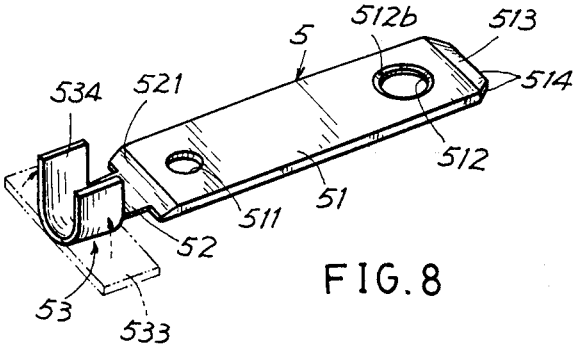
FIG. 8 is a perspective view of a plug blade made in accordance with the present invention.
Figure 9:
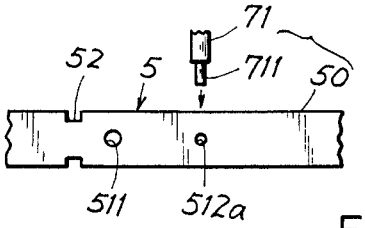
FIG. 9 shows a step for making a polarized plug blade of the present invention.
Figure 10:
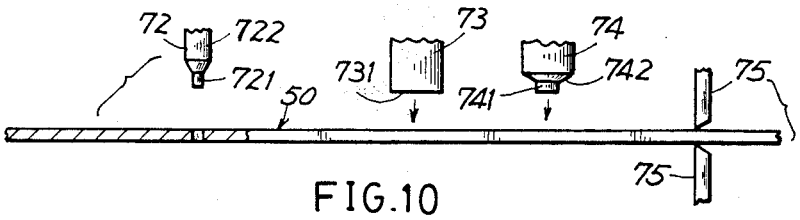
FIG. 10 is a sectional drawing stepwise showing the forming of polarized blades of the present invention.

The characteristic features of the present invention are shown in FIGS. 4–7 which comprises a thinning and flattening of the rear root portion 53 including: a primary pressing of a rear root portion 53 of a plug blade when firmly securing the front portion 51 of each blade 5 by a first ramming punch 61 having an arcuate bottom surface to form a small recess 531 concave in the rear portion 53; a secondary pressing of the rear portion 53 by a second ramming punch 62 having an arcuate bottom surface to form a large recess 532 concave in the rear portion 53; a tertiary pressing of the rear portion 53 by a flattening punch 63 to form a flat plate 533 widened transversely; and a bending of the flat plate 533 by a bending punch 64 within a U-shaped socket die 65 to form a bent rear portion 534 for crimping a wire lead of a power source. The formed blade 5 is shown in FIG. 8 for insertion into an electric plug (not shown).

Figure 11:
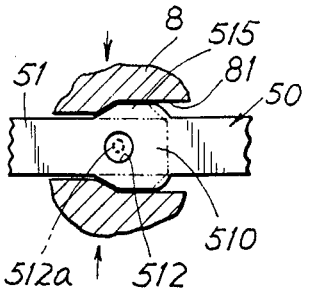
FIG. 11 is an illustration showing an enlarged front-end portion of the polarized plug blade of the present invention.
Figure 12:
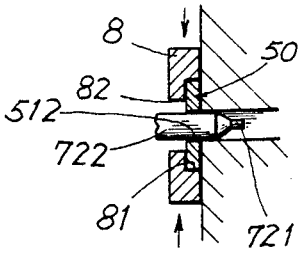
FIG. 12 is a cross sectional drawing of the enlarged polarized blade of FIG. 11.
Figure 13:
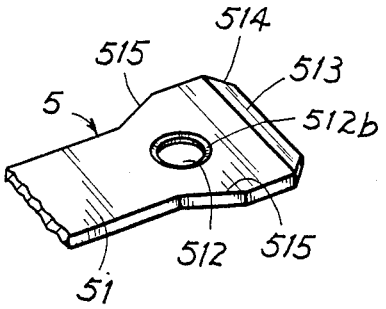
FIG. 13 is a perspective view showing a polarized plug blade of the present invention.

For making a polarized plug blade as shown in FIG. 13, several steps as shown in FIGS. 9–12 are further provided in addition to those steps used in making a non-polar blade 5 as shown in FIGS. 1–7.

Before punching the outer hole 512 as shown in FIG. 2, a smaller hole 512*a* such as 1 mm is perforated on an outer portion of the blade 5 by a first perforating punch 71 having a lower punch member 711 of 1 mm diameter. Then, a second perforating punch 72, having a lower small punch member 721 of 1 mm diameter and an upper large punch member 722 enlarged upwardly from the lower punch member 721 to have a diameter of 3.2 mm, is used to punch the outer hole 512 (3.2 mm diameter) of the front end portion 510 encased in a limiting die 8 as shown in FIGS. 11, 12.

The metal of the front end portion 510 is extended transversely when punched by the second perforating punch 72 to form a pair of widened extensions 515 as the bulged metal is limited by the limiting die 8 having a female socket 81 having a height generally equal to the thickness of the strip 50 and having a width larger than a width of the strip 50 and can only be extended into the two side portions of the socket 81. The die 8 is formed with a central opening 82 for poking the punch 72 therethrough as shown in FIG. 12.

A flattening punch 73 having a flat bottom surface 731 is then lowered to flatten the strip 50 after being punched as aforementioned. A third punch 74 having an enlarged portion 742 larger than the lower punch member 741 having a diameter of 3.2 mm is used to form a taper ring **512*b* as shown in FIG. 13, forming a polarized blade. A pair of milling cutters 75** are provided to remove any corrugated portion of the strip in order to produce a smooth blade surface.

Figure 14:
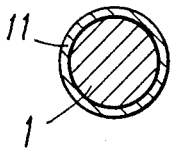
FIG. 14 is a cross sectional view of a copper-plated metallic rod for making the strip of the present invention.
Figure 15:
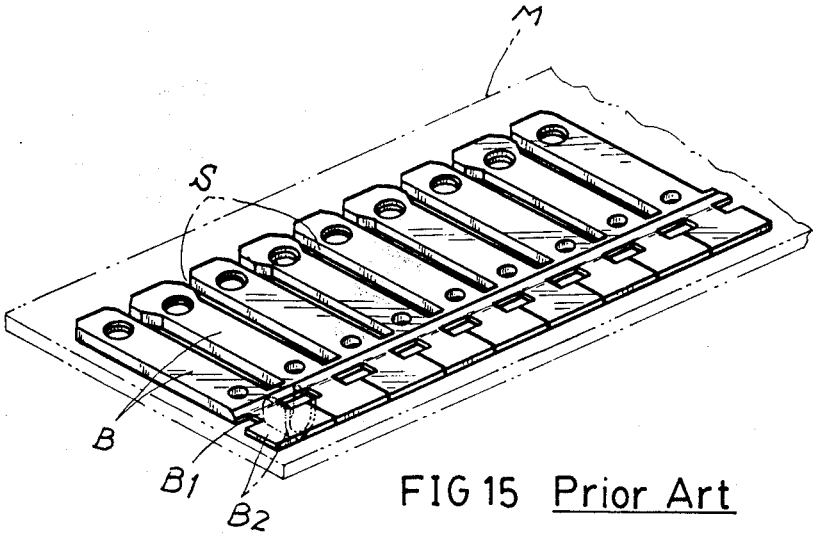
FIG 15 Prior Art
FIG. 15 shows a prior art for making plug blades.

As shown in FIG. 14, an outer layer of brass or copper 11 may be plated or encased on an electrically conductive metallic rod 1 such as an aluminum rod for saving cost.

The present invention has the following advantages superior to a conventional method for making plug blades:

1. A coil rod is formed as a linear strip and almost completely converted to plural plug blades for minimizing the wasting of scraps as cut from a copper plate.

2. The rear root portion 53 of a blade 5 is directly pressed, flattened, and thinned to form an U-shaped plate for crimping a wire without the need of soldering or without the need of milling of the rear portion 53 to be thinner.

3. The production steps can be made continuously for reducing production cost.

I claim:

1. A cost-saving process for making plug blades directly from a linear strip comprising:

A. forming a linear longitudinal strip having a general rectangular cross section thereof from a coil of metallic rod having electric conductivity;

B. punching the longitudinal strip to divide into a plurality of plug blades each having a front blade portion, a rear root portion pertaining to said front blade portion by an intermediate neck portion; and C. flattening the rear root portion of each said plug blade and bending the rear root portion for crimping a wire lead of a power source.

the improvement which comprises: flattening of said rear root portion of said plug blade including:

D. pressing said rear root portion by a first ramming punch having a first arcuate bottom surface to form a small recess concave in said rear root portion;

E. further pressing said rear root portion by a second ramming punch having a second arcuate bottom surface to form a larger recess concave in said rear root portion;

F. pressing said rear root portion for flattening the same by a flattening punch having a flat bottom surface for flattening and thinning the rear root portion; and G. bending said flattened rear root portion to be an U-shaped plate for crimping said wire lead.

2. A process according to claim 1, wherein said process for making plug blades comprises punching each plug blade of said longitudinal strip to form a small hole by a small perforating punch in an outer portion of said front blade portion, and further punching said small hole by a larger perforating punch to form an outer hole of said plug blade to transversely extend a bulged material of the blade towards two transverse sides of the longitudinal strip to form a polarized plug blade.

3. A process according to claim 2, wherein said front end portion of said plug blade is limited in a die encasing said front end portion of said blade having a female socket having a width wider than a width of said longitudinal strip and having a height equal to a thickness of said strip, whereby upon a punching of a small hole in an outer portion of said plug blade to form the outer hole, the bulged material of the front end portion of the blade is extended into two side portions of the female socket in the die, forming a pair of widened extensions adapted for a polarized plug blade.

4. A process according to claim 1, wherein said coil of metallic rod for forming the linear strip is selected from: a brass, a copper and an electrically conductive metallic rod plated or encased by an outer layer of brass or copper.

* * * * *